US006953114B2

(12) United States Patent
Wang

(10) Patent No.: US 6,953,114 B2
(45) Date of Patent: Oct. 11, 2005

(54) TOOLBOX

(76) Inventor: Mei-Chen Wang, No. 141, Lane Miu Tan, Shao An Li, Lu Kang Town, Chang Hua Hsien (TW)

( * ) Notice: Subject to any disclaimer, the term of this patent is extended or adjusted under 35 U.S.C. 154(b) by 128 days.

(21) Appl. No.: 10/409,930

(22) Filed: Apr. 9, 2003

(65) Prior Publication Data

US 2004/0200749 A1 Oct. 14, 2004

(51) Int. Cl.[7] ..... B65D 85/00
(52) U.S. Cl. ..... 206/375; 206/372; 206/377
(58) Field of Search ..... 206/369, 372–377, 206/379, 443

(56) References Cited

U.S. PATENT DOCUMENTS 4,880,122 A * 11/1989 Martindell ..... 211/70.6
5,108,287 A * 4/1992 Yee et al. ..... 433/77
5,203,469 A * 4/1993 Chang et al. ..... 220/812
5,535,881 A * 7/1996 Krivec ..... 206/376
5,535,882 A * 7/1996 Liu ..... 206/377
5,551,559 A * 9/1996 Roth et al. ..... 206/308.1
5,562,208 A * 10/1996 Hasler et al. ..... 206/373
5,595,294 A * 1/1997 McKenzie et al. ..... 206/349
6,113,867 A * 9/2000 Mayer ..... 422/300
6,257,409 B1 * 7/2001 Lin ..... 206/376
6,398,027 B1 * 6/2002 Ryu ..... 206/362
6,547,074 B1 * 4/2003 Chen ..... 206/379
2004/0069668 A1 * 4/2004 Finnigan ..... 206/372

* cited by examiner

*Primary Examiner*—Jim Foster
*Assistant Examiner*—Jerrold D. Johnson
(74) *Attorney, Agent, or Firm*—Alan D. Kamrath; Nikolai & Mersereau, P.A.

(57) ABSTRACT

A toolbox is provided for receiving tool bits each with an annular groove. The toolbox includes a box and a holder for pivotal installment in the box. The holder includes holes defined therein and hooks each located in one of the holes. Each of the holes is for receiving one of the tool bits. Each of the hooks includes an enlarged end for insertion in the annular groove of one of the tool bits.

19 Claims, 6 Drawing Sheets

TOOLBOX

BACKGROUND OF INVENTION

1. Field of Invention

The present invention relates to a toolbox.

2. Related Prior Art

Referring to FIG. 8, a conventional toolbox 70 includes two shells pivotally connected with each other, two bases 72 each formed on one of the shells and two holders 74 each pivotally connected with one of the bases 72. Many pairs of rods 73 extend from each of the bases 72. The holder 74 defines many holes 75 and many windows 76 each communicated with one of the holes 75. Each hole 75 can receive a tool bit 80. When a bolder 74 is pivoted to a lying position against a base 72, each pair of rods 73 extends into a window 76 in order to pinch a tool bit 80. Each tool bit 80 is however released from a pair of rods 73 as a holder 74 is moved from the lying position relative to a base 72. As one shell is pivoted relative to the other shell, the holders 74 may accidentally be moved from the lying position relative to the bases 72 because of the weight of the tool bits 80. Thus, the tool bits 80 may be released from the pairs of rods 73. Therefore, each tool bit 80 may escape from the holder 74.

The present invention is therefore intended to obviate or at least alleviate the problems encountered in the prior art.

SUMMARY OF INVENTION

It is the primary objective of the present invention to provide a toolbox for securely holding tool bits each with an annular groove.

According to the present invention, a toolbox includes a box and a holder for pivotal installment in the box. The holder includes holes defined therein and hooks each located in one of the holes. Each of the holes is for receiving one of the tool bits. Each of the hooks includes an enlarged end for insertion in the annular groove of one of the tool bits.

Other objectives, advantages, and novel features of the invention will become more apparent from the following detailed description when taken in conjunction with the attached drawings.

BRIEF DESCRIPTION OF DRAWINGS

The present invention will be described through detailed illustration of embodiments referring to the attached drawings wherein.

DETAILED DESCRIPTION OF EMBODIMENTS

Figure 1:
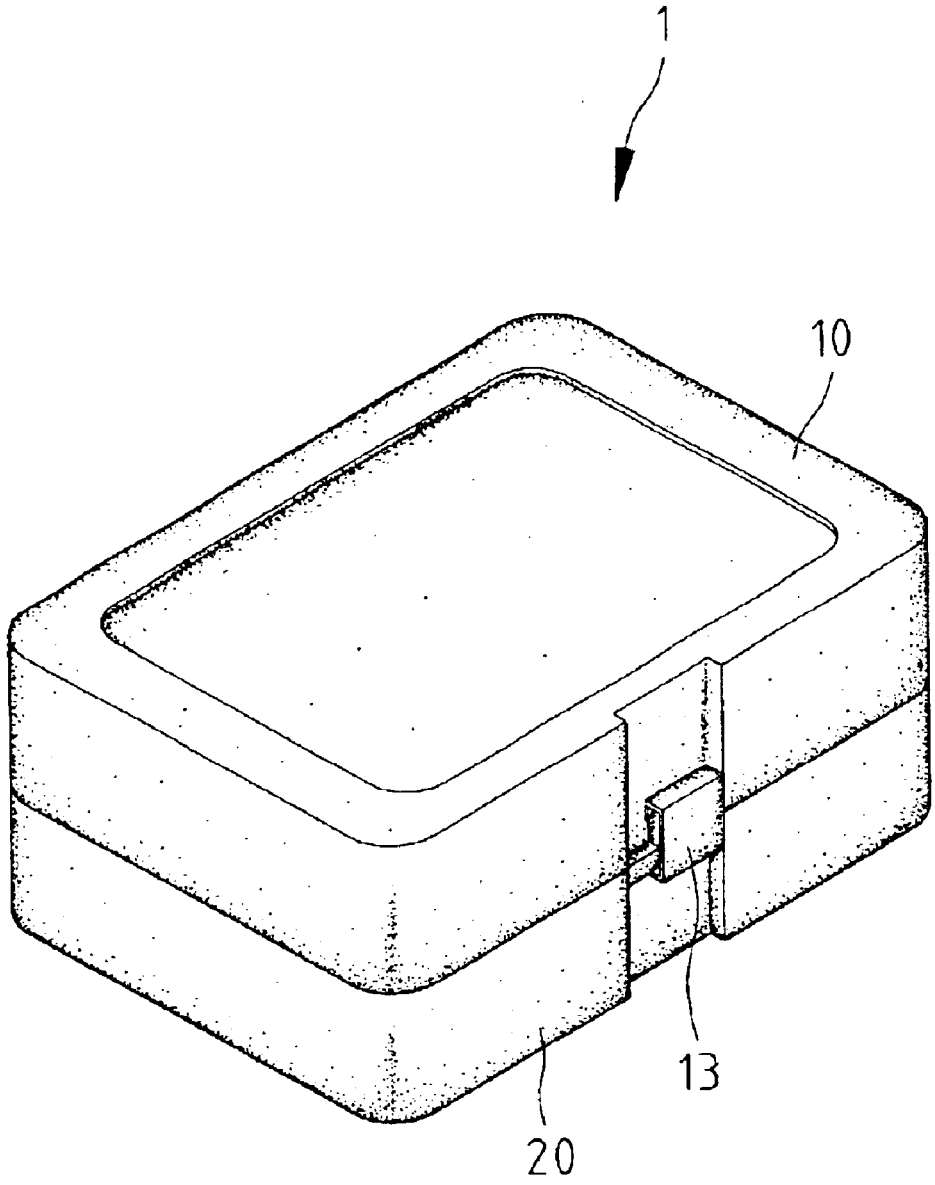
FIG. 1 is a perspective view of a toolbox according to a first embodiment of the present invention.

Referring to FIG. 1, according to a first embodiment of the present invention, a toolbox 1 includes a first shell 10 and a second shell 20 pivotally connected with the first shell 10. A lock 13 is installed for closing the toolbox 1.

Figure 2:
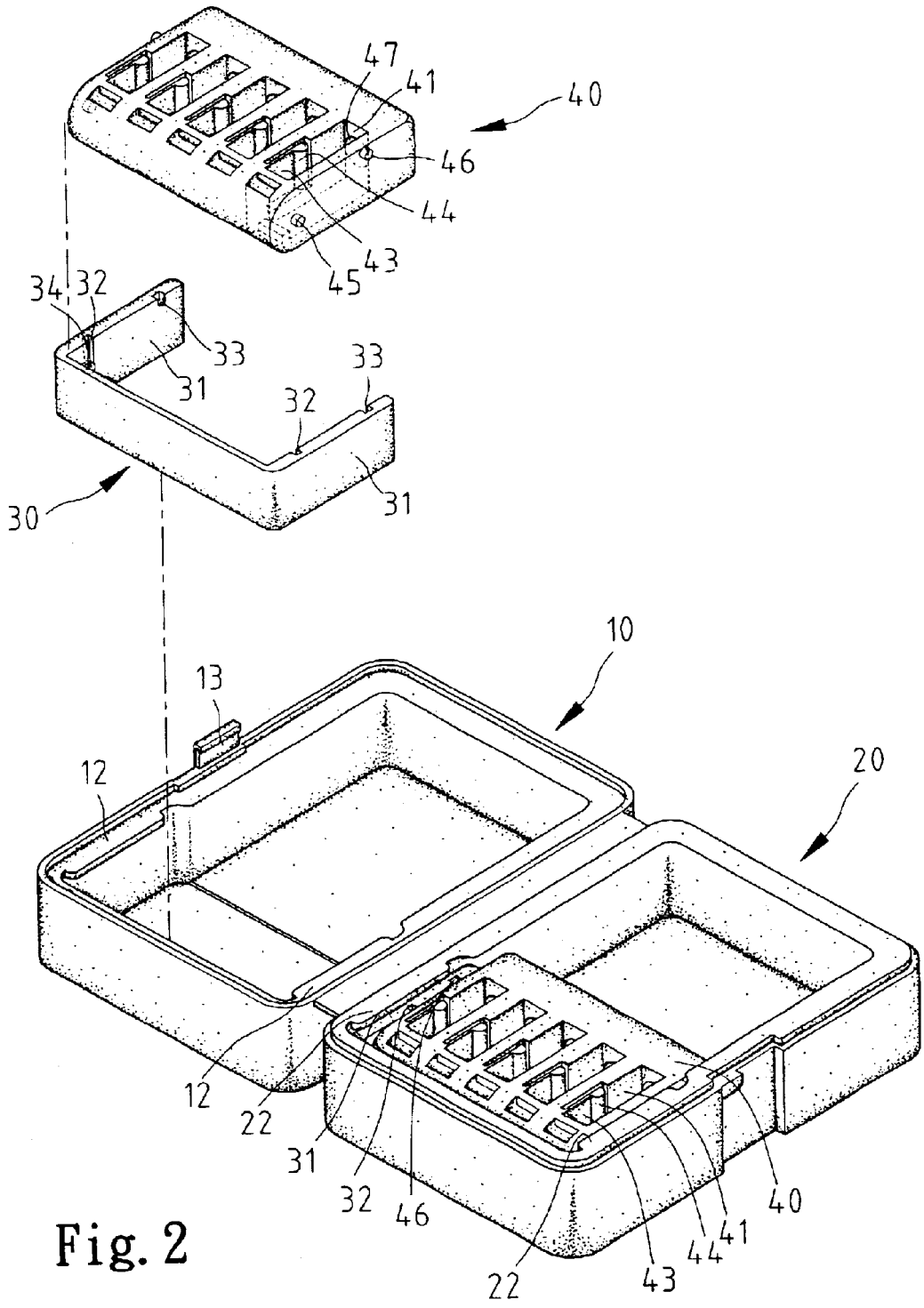
FIG. 2 is an exploded view of the toolbox shown in FIG. 1.

Referring to FIG. 2, the first shell 10 includes two fins 12 extending from an edge, and the second shell 20 includes two fins 22 extending from an edge.

The toolbox 1 further includes two frames 30 each attached to the shell 10 or 20 in a removable manner and two holders 40 each pivotally connected with one of the frames 30 in a removable manner.

Each frame 30 includes a U-shaped structure with two lateral members 31. When a frame 30 is attached to the shell 10 or 20, its lateral members 31 are limited by the fins 12 or 22. Each lateral member 31 of each frame 30 defines a groove 32, a recess 34 to which the groove 32 leads and a recess 33.

Each holder 40 defines holes 47 and windows 41 each communicated with one of the holes 47. A hook 43 extends from a wall of each window 41. Each hook 43 is formed with elasticity. Each hook 43 includes an enlarged end 44. Each holder 40 further includes two sides on each of which a first boss 45 and a second boss 46 are formed. Each first boss 45 is moved through a groove 32 into the recess 34. Thus, each holder 40 is pivotally connected with a frame 30. Each second boss 46 can be moved into a recess 33 for keeping a holder 40 close to a frame 30.

Figure 3:
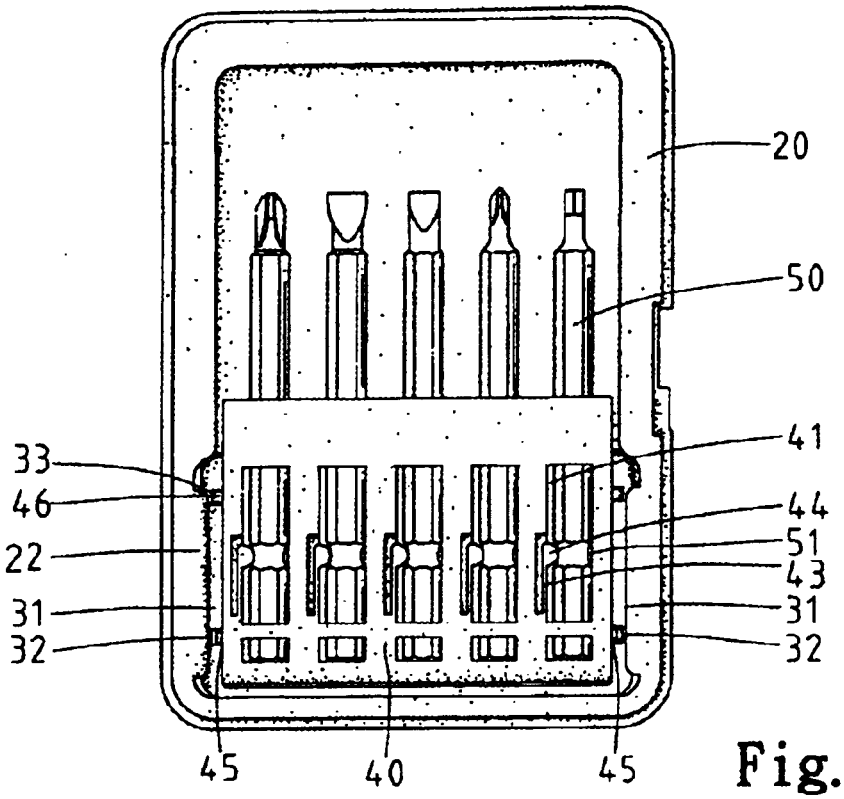
FIG. 3 is top view of a shell and a holder of the toolbox shown in FIG. 2.

Referring to FIG. 3, some tool bits 50 are shown. Each tool bit 50 defines an annular groove 51. The tool bits 50 are inserted into the holes 47. The enlarged end 44 of each hook 43 enters the annular groove 51 of each tool bit 50, thus retaining each tool bit 50 in a hole 47.

Figure 4:
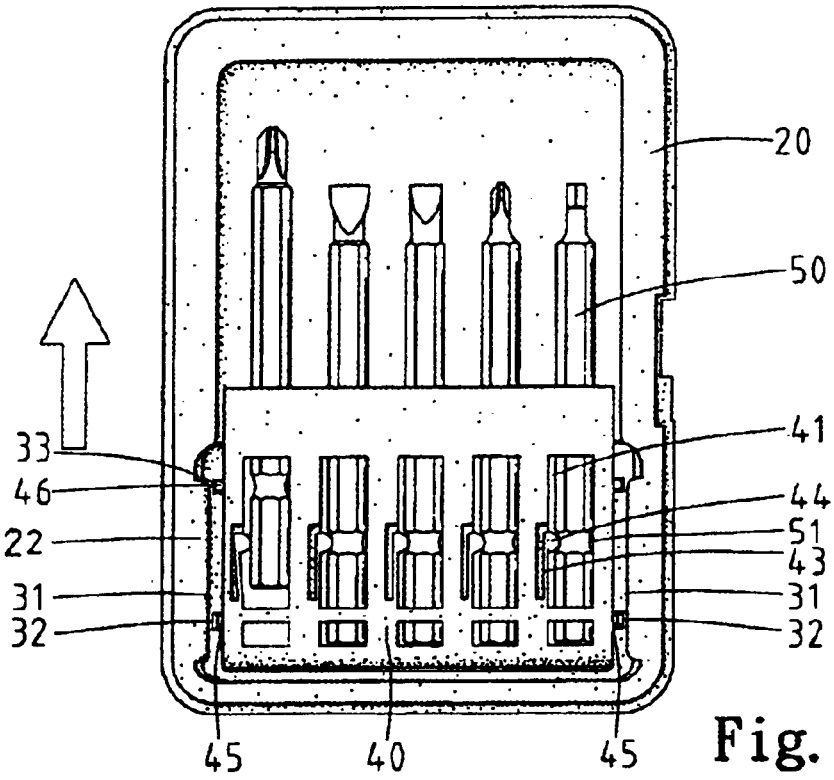
FIG. 4 is similar to FIG. 3 but showing the holder in a different position.

Referring to FIG. 4, a tool bit 50 is removed from a hole 47. The enlarged end 44 of that hook 43 escapes from the annular groove 51 of that tool bit 50 because of the elasticity of the hook 43.

Figure 5:
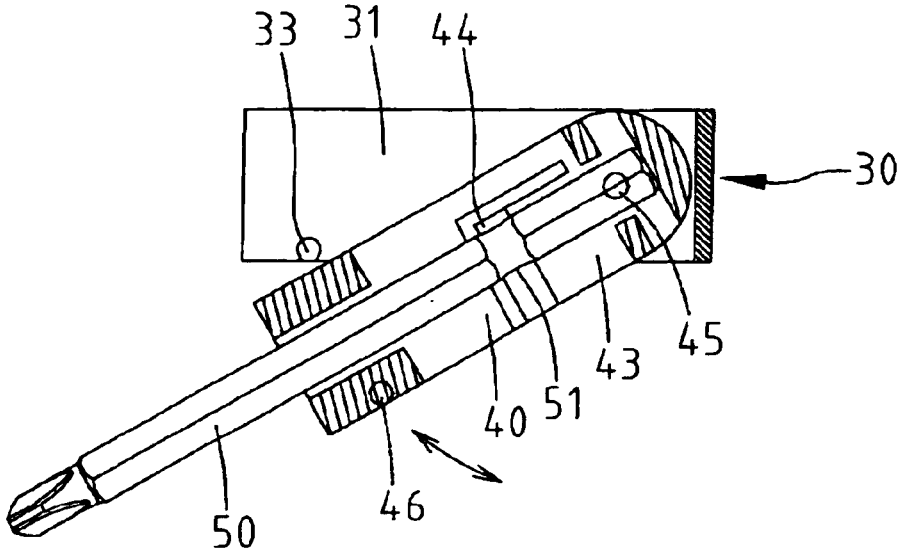
FIG. 5 is a cross-sectional view of the holder shown in FIG. 3.
Figure 6:
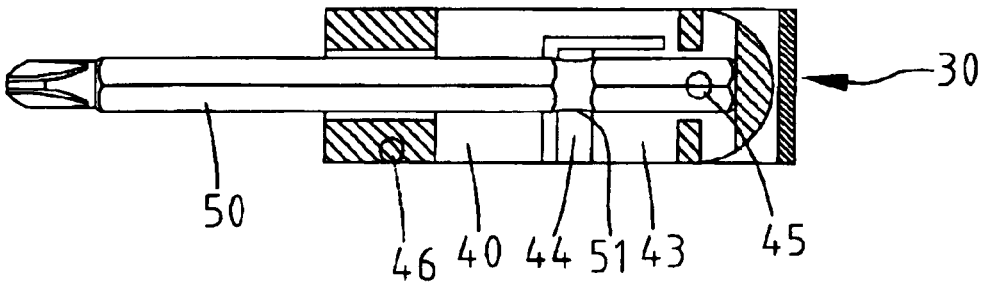
FIG. 6 is similar to FIG. 5 but showing the holder in a different position.

Referring to FIGS. 5 and 6, the holders 40 can be pivoted relative to the frames 30 between various positions without removing the enlarged ends 44 of the hooks 43 from the annular grooves 51 of the tool bits 50 since the hooks 43 are formed on the holders 40 instead of the frames 30. Thus, the tool bits 50 are retained by the hooks 43 unless they are deliberately removed.

Figure 7:
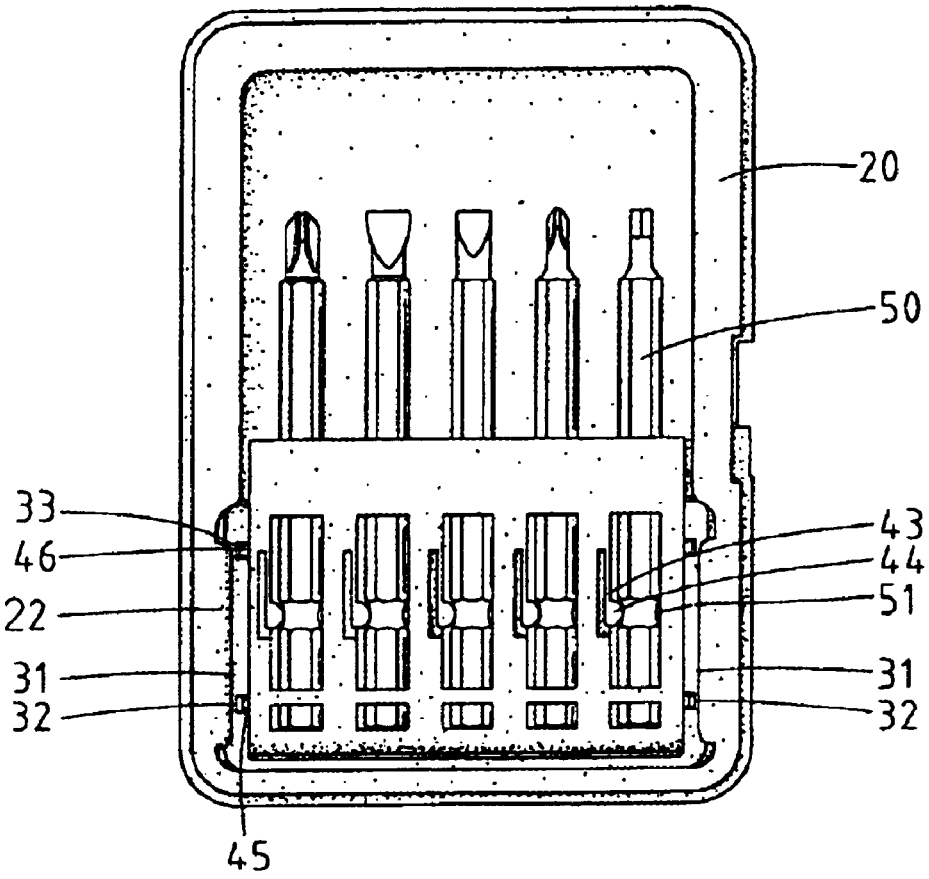
FIG. 7 is top view of a shell and a holder of a toolbox according to a second embodiment of the present invention.
Figure 8:
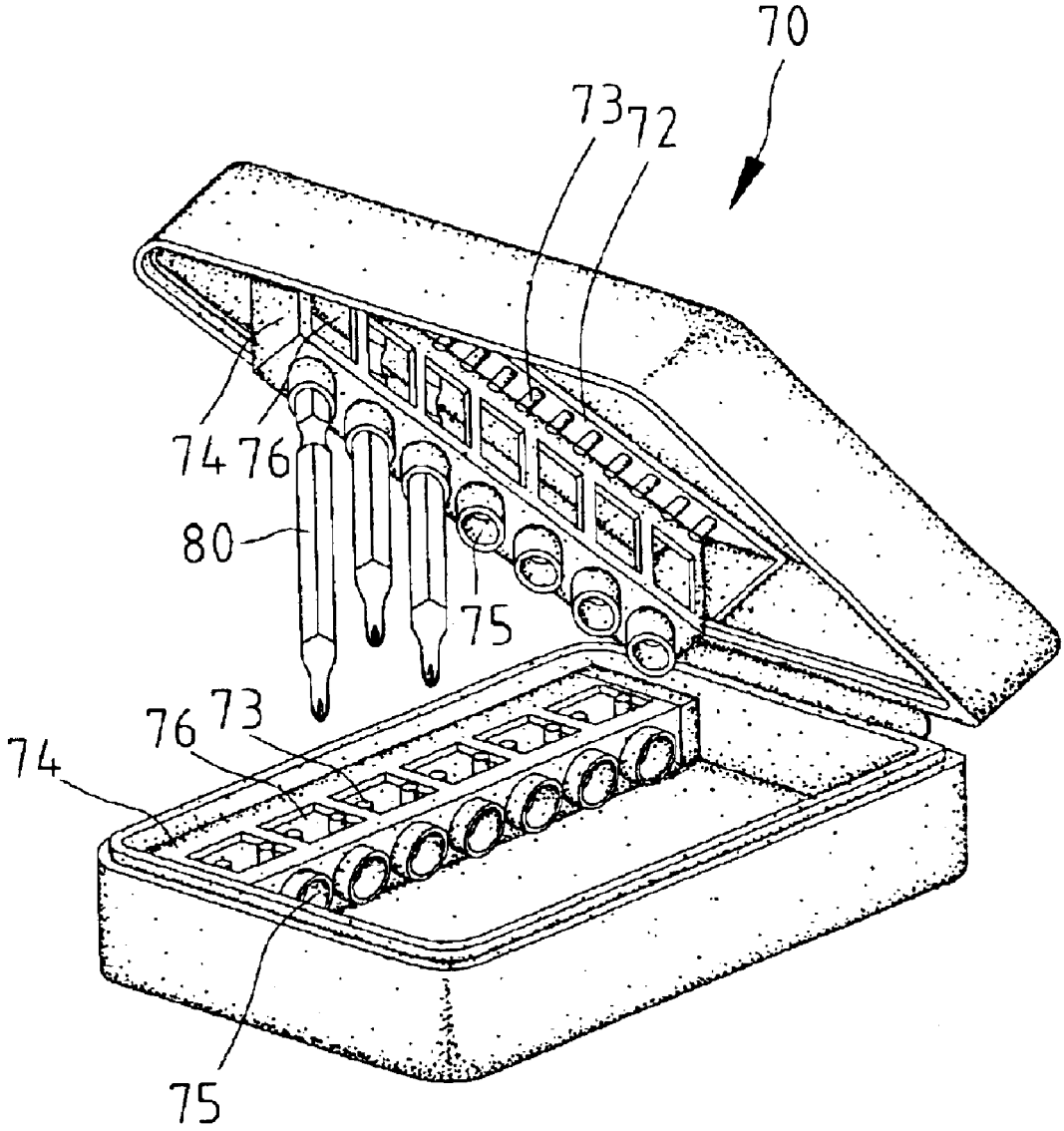
Fig. 8 PRIOR ART
FIG. 8 is a perspective view of a conventional toolbox.

FIG. 7 shows a toolbox according to a second embodiment of the present invention.

The second embodiment is identical to the first embodiment except that the hooks 43 extend in a different direction.

The present invention has been described via detailed illustration of two embodiments. Those skilled in the art can derive variations from the embodiments without departing from the scope of the present invention. Therefore, the embodiments shall not limit the scope of the present invention defined in the claims.

What is claimed is:

1. A toolbox for receiving tool bits each with an annular groove, the toolbox including a box and a holder for pivotal installment in the box, with the holder including a plurality of axially extending holes defined therein for receiving the tool bits, with the holder further including a plurality of hooks attached to the holder and pivotal with the holder relative to the box, with each hook located in one of the axially extending holes and formed with an enlarged end for insertion in the annular groove of one of the tool bits, with the enlarged ends being radially movable in the holes, wherein the hook includes an elongated portion having a first end secured to the holder within the hole, with the elongated portion having the enlarged end opposite to the first end.

2. The toolbox according to claim 1 further including a frame for installment in the box and in pivotal connection with the holder.

3. The toolbox according to claim 2 wherein the box includes two fins formed thereon for retaining the holder therein.

4. The toolbox according to claim 2 wherein the frame is a U-shaped structure with two lateral members.

5. The toolbox according to claim 4 wherein the box includes two fins formed thereon for retaining the holder therein.

6. The toolbox according to claim 5 wherein the holder includes two sides each for pivotal connection with one of the lateral members of the frame.

7. The toolbox according to claim 6 wherein each of the lateral members of the frame defines a recess, and each of the sides of the holder includes a boss formed thereon for insertion in the recess of one of the lateral members of the frame.

8. The toolbox according to claim 7 wherein each of the lateral members of the frame further defines a groove leading to the recess.

9. The toolbox according to claim 7 wherein each of the lateral members of the frame defines a second recess, and each of the sides of the holder includes a second boss formed thereon for insertion in the second recess of one of the lateral members of the frame.

10. The toolbox according to claim 1 wherein the holder defines windows each communicated with one of the holes, with the hooks each extending from a wall of the window.

11. The toolbox according to claim 1 wherein the box includes two shells pivotally connected with each other.

12. The toolbox according to claim 11 including two holders each for pivotal installment in one of the shells.

13. The toolbox according to claim 12 wherein each of the shells includes two fins formed thereon for retaining one of the holders therein.

14. The toolbox according to claim 12 further including two frames for installment in one of the shells and in pivotal connection with one of the holders.

15. The toolbox according to claim 14 wherein each of the frames is a U-shaped structure with two lateral members.

16. The toolbox according to claim 15 wherein each of the shells includes two fins formed thereon for retaining one of the holders therein.

17. The toolbox according to claim 1 wherein the first end of the elongated portion is integrally formed as a single undivided component for the holder.

18. The toolbox according to claim 17 wherein the enlarged end is a free end of the elongated portion.

19. The toolbox according to claim 18 wherein the holder defines windows each communicated with one of the holes, with the hooks each extending from a wall of the window.

* * * * *